US009996047B2

(12) United States Patent
Kawakami et al.

(10) Patent No.: US 9,996,047 B2
(45) Date of Patent: Jun. 12, 2018

(54) CLEANING BLADE, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Tomoya Kawakami, Suntou-gun (JP); Arihiro Yamamoto, Suntou-gun (JP); Masaaki Kimura, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/404,426

(22) Filed: Jan. 12, 2017

(65) Prior Publication Data

US 2017/0212469 A1 Jul. 27, 2017

(30) Foreign Application Priority Data

Jan. 22, 2016 (JP) ..... 2016-010734
Oct. 21, 2016 (JP) ..... 2016-206768

(51) Int. Cl.
*G03G 15/00* (2006.01)
*G03G 21/00* (2006.01)
*G03G 21/18* (2006.01)

(52) U.S. Cl.
CPC ..... *G03G 21/0017* (2013.01); *G03G 21/18* (2013.01)

(58) Field of Classification Search
CPC ..... G03G 21/0017; G03G 21/1814; G03G 21/0011; G03G 15/161
See application file for complete search history.

(56) References Cited

U.S. PATENT DOCUMENTS 8,594,553 B2 11/2013 Uematsu et al.
2009/0041519 A1* 2/2009 Uchida ..... G03G 21/0017 399/350
2014/0086624 A1* 3/2014 Kojima ..... G03G 21/0017 399/111
2015/0338819 A1* 11/2015 Ai ..... G03G 21/0011 399/350
2017/0003644 A1 1/2017 Yamamoto et al.

FOREIGN PATENT DOCUMENTS

JP 2001-75451 A 3/2001
JP 2012-53311 A 3/2012

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

Provided is a cleaning blade including: an elastic member; and a supporting member supporting the elastic member. The elastic member includes a free end portion, and the free end portion has an edge and a first surface and a second surface that form the edge. At least one of the first surface and the second surface has a hardened surface. The following expression (1): $0.1 \leq DHs \leq 0.4$ and the following expression (2): $DHs < DHm$ are satisfied, where DHs ($mN/\mu m^2$) represents a dynamic hardness of the hardened surface, and DHm ($mN/\mu m^2$) represents a maximum value of the dynamic hardness obtained in a positional range in which a distance L from the edge on a straight line that bisects an angle of the edge in a cross-section of the elastic member orthogonal to a longitudinal direction thereof satisfies $0\ \mu m < L \leq 100\ \mu m$.

11 Claims, 7 Drawing Sheets

CLEANING BLADE, PROCESS CARTRIDGE, AND ELECTROPHOTOGRAPHIC IMAGE FORMING APPARATUS

BACKGROUND OF THE INVENTION

Field of the Invention

The present invention relates to a cleaning blade which is to be used in an electrophotographic image forming apparatus, a process cartridge, and an electrophotographic image forming apparatus.

Description of the Related Art

An electrophotographic image forming apparatus includes a cleaning member configured to remove a toner remaining on an image bearing member, e.g., a photosensitive member after a toner image is transferred from the image bearing member onto a body to be transferred, e.g., a sheet or an intermediate transfer member. Of those cleaning members, a cleaning blade using a plate-like elastic member has been well known. In recent years, in order to meet the demand for improving an image quality of an electrophotographic image, attempts have been made to perform diameter reduction and spheroidization of a toner, with the result that the toner remaining on the image bearing member becomes liable to pass through the cleaning blade. Therefore, the cleaning blade is required to have more excellent cleaning performance.

In Japanese Patent Application Laid-Open No. 2001-75451, there is disclosed a cleaning blade in which the hardness of an abutment portion of the cleaning blade formed of a polyurethane elastomer is increased by increasing the concentration of an isocyanurate group of the abutment portion. There is also disclosed that, with the foregoing, friction between an image bearing member and the cleaning blade is reduced. Further, in Japanese Patent Application Laid-Open No. 2012-53311, there is disclosed a cleaning blade in which a tip end portion of the cleaning blade is subjected to hardening treatment, and further, the physical properties of an inner portion in the tip end portion subjected to the hardening treatment are regulated without impairing rubber elasticity.

SUMMARY OF THE INVENTION

According to one aspect of the present invention, there is provided a cleaning blade, including: an elastic member; and a supporting member supporting the elastic member, the elastic member including a free end portion, the free end portion having an edge and a first surface and a second surface that form the edge, at least one of the first surface and the second surface having a hardened surface, in which relationships represented by the following expressions (1) and (2) are satisfied:

$$0.1 \leq DHs \leq 0.4; \text{ and} \quad (1)$$

$$DHs < DHm, \quad (2)$$

where DHs ($mN/\mu m^2$) represents a dynamic hardness of the hardened surface, and DHm ($mN/\mu m^2$) represents a maximum value of the dynamic hardness obtained in a positional range in which a distance L from the edge on a straight line that bisects an angle of the edge in a cross-section of the elastic member orthogonal to a longitudinal direction of the elastic member satisfies $0\ \mu m < L \leq 100\ \mu m$.

According to another aspect of the present invention, there is provided a process cartridge including the cleaning blade. According to still another aspect of the present invention, there is provided an electrophotographic image forming apparatus including the cleaning blade.

According to one aspect of the present invention, the cleaning blade capable of exhibiting more excellent cleaning performance can be obtained. Further, according to another embodiment of the present invention, the process cartridge and the electrophotographic image forming apparatus that contribute to the formation of a high-quality electrophotographic image can be obtained.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present invention is directed to providing a cleaning blade capable of exhibiting more excellent cleaning performance. The present invention is further directed to providing a process cartridge and an electrophotographic image forming apparatus that contribute to stable formation of a high-quality electrophotographic image.

As a member to be cleaned to which the cleaning blade of the present invention is applied, there are given an image bearing member, e.g., a photosensitive member and an endless belt, e.g., an intermediate transfer belt. Now, taking a photosensitive member as an example of the member to be cleaned, the cleaning blade according to an embodiment of the present invention is described in detail.

<Configuration of Cleaning Blade>

Figure 1A:
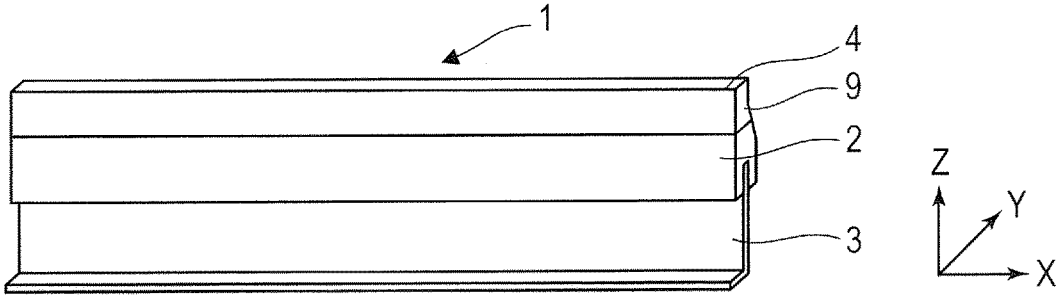
FIG. 1A is a perspective view for illustrating an example of an integrally molded cleaning blade according to the present invention.
Figure 1B:
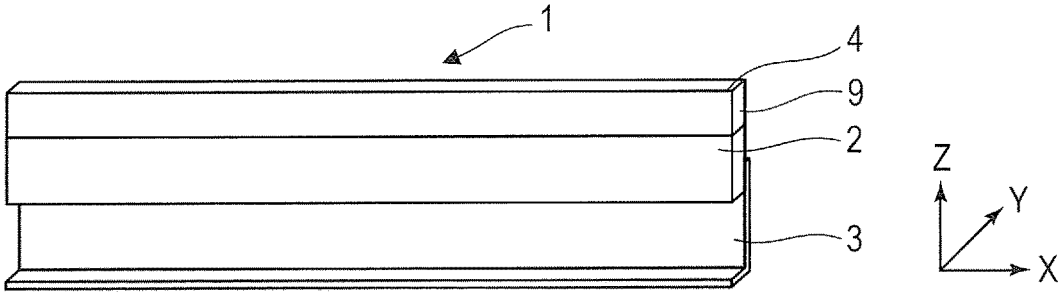
FIG. 1B is a perspective view for illustrating an example of a cleaning blade of an adhesion type according to the present invention.
Figure 2:
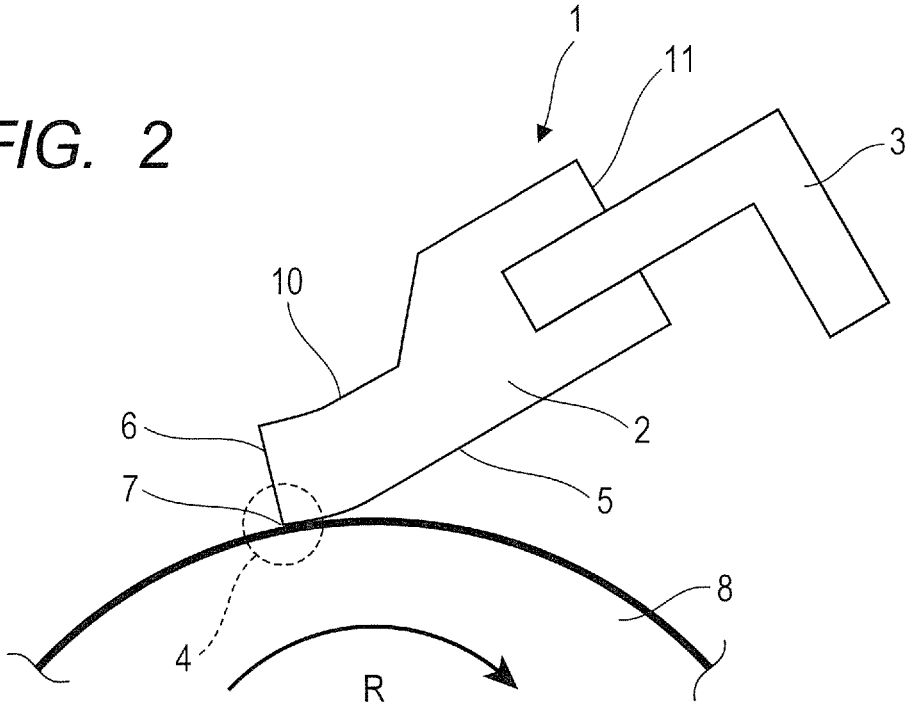
FIG. 2 is a view for illustrating a state in which an edge of the cleaning blade is brought into abutment against a member to be cleaned at a time when a process cartridge stands still. A longitudinal direction (X direction) of an elastic member represents a direction perpendicular to the drawing sheet of FIG. 2.
Figure 3:
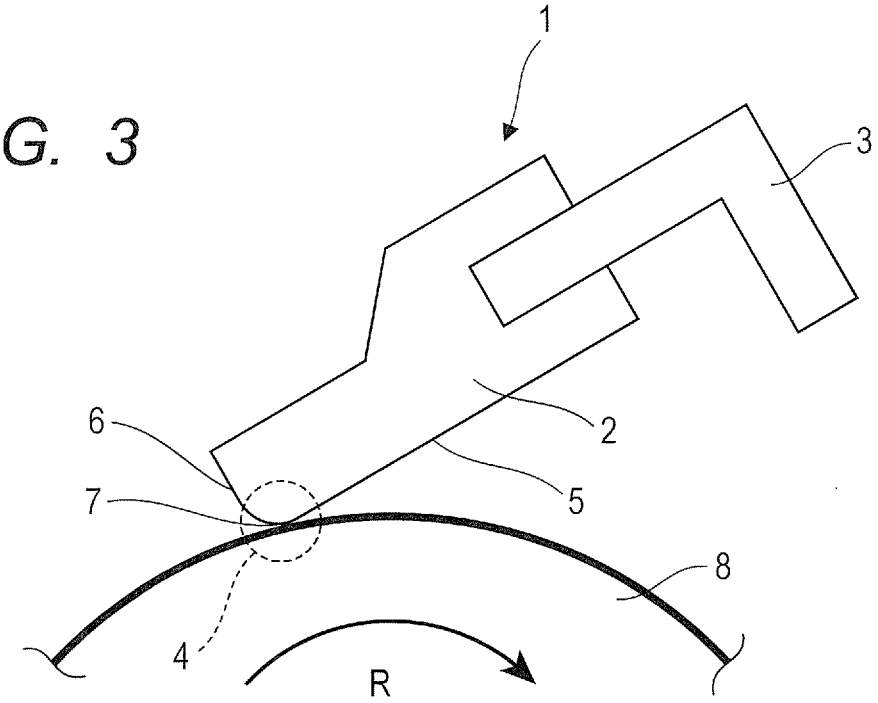
FIG. 3 is a view for illustrating a state in which the cleaning blade is brought into abutment against the member to be cleaned at a time when the process cartridge is operated.

FIG. 1A, FIG. 1B, FIG. 2, and FIG. 3 are each a view for illustrating an example of the cleaning blade according to the present invention. FIG. 1A and FIG. 1B are each a schematic view for illustrating a configuration of the cleaning blade. The cleaning blade of the present invention includes an elastic member 2 and a supporting member 3 supporting the elastic member 2. The elastic member 2 includes an edge 7 that is brought into abutment against the member 8 to be cleaned, and a first surface (lower surface 5) and a second surface (vertical surface 6) that form the edge 7. At least one of the first surface and the second surface has a hardened surface that is brought into abutment against the member to be cleaned. That is, from the viewpoint of realizing the enhancement of cleaning performance, a hardened region 4 is formed on a surface of at least one of the first surface and the second surface which is brought into abutment against the member 8 to be cleaned, the surfaces being located on both sides of the edge 7 of the cleaning blade 1, in which the edge 7 is brought into abutment against the member 8 to be cleaned; and a hardened region 4 is formed in an inner portion in the vicinity of the surface. In FIG. 1A and FIG. 1B, a "longitudinal direction" of the cleaning blade 1 corresponds to an X direction, and a "transverse direction" and a "thickness direction" thereof correspond to a Z direction and a Y direction, respectively. In FIG. 2 and FIG. 3, the member 8 to be cleaned is rotated in a direction of an arrow R.

In the cleaning blade of the present invention, a "free end" of the elastic member refers to an end portion of the elastic member on a side opposite to an end portion supported by the supporting member. Further, a "free end portion" of the elastic member refers to the free end and the vicinity thereof. An "edge" refers to an abutment portion of the cleaning blade to be brought into abutment against the member to be cleaned, and the abutment portion is a ridge portion formed by the intersection of the first surface and the second surface. The "first surface" refers to, for example, a lower surface 5 or a vertical surface 6 of the elastic member 2 of FIG. 2. The "second surface" refers to, for example, the vertical surface 6 or the lower surface 5 of the elastic member 2 of FIG. 2. Now, description is made of an exemplary case in which the lower surface 5 serves as the first surface and the vertical surface 6 serves as the second surface. The free end of the elastic member and the vicinity thereof may be referred to as "tip end portion" of the elastic member or "tip end portion" of the cleaning blade in some cases.

FIG. 1A is an illustration of an example of the cleaning blade in which the elastic member 2 and the supporting member 3 are integrally molded. The cleaning blade of this example can be obtained by setting the supporting member 3 in a mold, injecting a raw material composition, e.g., a polyurethane elastomer, into the mold, and causing the raw material composition to react to be hardened by heating, followed by demolding. After the demolding, for example, the tip end portion of the free end of the elastic member 2 in the Z direction and both end portions of the elastic member 2 in the X direction can be cut as necessary. A step of forming a hardened region 4 in the tip end portion of the elastic member 2 may be performed before or after the cutting. With this, the cleaning blade in which the elastic member 2 and the supporting member 3 are integrated can be obtained.

FIG. 1B is an illustration of an example of a cleaning blade of an adhesion type obtained by separately molding a sheet for an elastic member, cutting the sheet into a strip shape to form the elastic member 2, and causing the elastic member 2 to adhere to the supporting member 3 with an adhesive or the like. The step of forming the hardened region 4 in the tip end portion of the elastic member 2 may be performed before or after adhesion of the elastic member 2 to the supporting member 3.

[Supporting Member]

There is no particular limitation on a material for forming the supporting member of the cleaning blade of the present invention, and the following materials can be given, for example. The materials include metal materials such as a steel plate, a stainless steel plate, a zinc-coated steel plate, and a chromium-free steel plate, and resin materials such as 6-nylon and 6,6-nylon. There is no particular limitation on the structure of the supporting member. The elastic member 2 of the cleaning blade 1 is supported by the supporting member 3 at one end as illustrated in FIG. 2, for example.

[Elastic Member]

Examples of the constituent material of the elastic member of the cleaning blade of the present invention include the following materials: a polyurethane elastomer, an ethylene-propylene-diene copolymer rubber (EPDM), an acrylonitrile-butadiene rubber (NBR), a chloroprene rubber (CR), a natural rubber (NR), an isoprene rubber (IR), a styrene-butadiene rubber (SBR), a fluorine rubber, a silicone rubber, an epichlorohydrin rubber, a hydrogenated product of NBR, and a polysulfide rubber. As the polyurethane elastomer, a polyester urethane elastomer is preferred from the viewpoint of being excellent in mechanical characteristics. The polyurethane elastomer is a material obtained mainly from raw materials such as a polyisocyanate, a polyol, a chain extender, a catalyst, and other additives. Those raw materials are described in detail below.

Examples of the polyisocyanate include: 4,4'-diphenylmethane diisocyanate (MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, and polymethylene phenyl polyisocyanate (PAPI). Of those, MDI is preferred from the viewpoint that a polyurethane elastomer excellent in mechanical characteristics is obtained.

Examples of the polyol include: polyester polyols, such as polyethylene adipate polyol, polybutylene adipate polyol, polyhexylene adipate polyol, (polyethylene/polypropylene) adipate polyol, (polyethylene/polybutylene) adipate polyol, and (polyethylene/polyneopentylene) adipate polyol; polycaprolactone-based polyols obtained by subjecting a caprolactone to ring-opening polymerization; polyether polyols, such as polyethylene glycol, polypropylene glycol, and polytetramethylene glycol; and polycarbonate diols. One kind of those polyols may be used alone, or two or more kinds thereof may be used in combination. Of the polyols, polyester polyols are preferred from the viewpoint that a polyurethane elastomer excellent in mechanical characteristics can be obtained.

As the chain extender, a chain extender capable of extending a polyurethane elastomer chain, such as a glycol, may be used. Examples of such glycol include: ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. In addition, other polyhydric alcohols may be used as well as the glycol. Examples thereof may include trimethylolpropane, glycerin, pentaerythritol, and sorbitol. One kind of those polyhydric alcohols may be used alone, or two or more kinds thereof may be used in combination.

As the catalyst, a generally used catalyst for curing a polyurethane elastomer may be used, and examples thereof include tertiary amine catalysts, specifically, the following catalysts: amino alcohols, such as dimethylethanolamine and N,N,N'-trimethylaminopropylethanolamine; trialkyl amines, such as triethyl amine; tetraalkyl diamines, such as N,N,N',N'-tetramethyl-1,3-butanediamine; triethylenediamine; piperazine-based compounds; and triazine-based compounds. In addition, alkali metal organic acid salts, such as potassium acetate and potassium octylate, may also be used. In general, a metal catalyst to be used for urethanation, e.g., dibutyltin dilaurate, may also be used. Those catalysts may be used alone, or two or more kinds thereof may be used in combination.

Additives, such as a pigment, a plasticizer, a waterproof agent, an antioxidant, a UV absorber, and a light stabilizer, may be blended in those raw material compositions as necessary.

There is no particular limitation on the angle of the edge formed by the first surface and the second surface of the elastic member of the present invention, but the angle is generally from about 85° to about 95°.

The international rubber hardness degree (IRHD) of the elastic member of the present invention is preferably 60 or more, more preferably 65 or more.

[Formation Portion of Hardened Region]

It is effective for realizing the enhancement of cleaning performance that the formation portion of the hardened region in the tip end portion of the elastic member is a surface of at least one of the first surface and the second surface that is brought into abutment against the member to be cleaned and an inner portion in the vicinity of the surface. When the member to be cleaned is a photosensitive member, an image forming area on the surface of the photosensitive member is brought into abutment against the edge of the cleaning blade, and is cleaned.

The hardened region may be further formed on other surfaces of the tip end portion of the elastic member, that is, a surface (surface 10 of FIG. 2) opposed to the first surface, and both end surfaces (surface 9 of FIG. 1A and FIG. 1B) in the longitudinal direction of the elastic member. In this case, the rigidity of both end surface portions of the elastic member can be enhanced, and turn-up of the cleaning blade can be even more reduced.

[Method of Forming Hardened Region]

The hardened region in the elastic member can be formed by applying a material for forming a hardened region to a region intended to have high hardness, followed by hardening. The material for forming a hardened region is used by being diluted with a diluting solvent as necessary, and can be applied by a known method such as dipping, spraying, dispensing, brushing, or roller coating. As the material for forming a hardened region, an isocyanate compound or the like described later can be used. In order to form the high hardness region in an inner portion rather than a surface, it is necessary to sufficiently impregnate the elastic member with the material for forming a hardened region (isocyanate compound, etc.). Impregnation is accelerated by setting the material for forming a hardened region to a high concentration and a low viscosity, and hence it is effective to heat the material for forming a hardened region, for example, without diluting the material for forming a hardened region. The temperature of the material is preferably 60° C. or more.

Now, an example of the method of forming a hardened region is described by way of an example using an isocyanate compound as the material for forming a hardened region. An elastic member having the material for forming a hardened region applied thereto may be referred to as "precursor".

In order to form a high hardness region in an inner portion rather than the surface of the elastic member, it is preferred that the material for forming a hardened region be applied, and then the precursor be subjected to heating treatment. Due to the heating treatment, the viscosity of the material for forming a hardened region, which is present on the surface of the elastic member, is decreased, to thereby accelerate the permeation and diffusion of the material into an inner portion of the elastic member. There is no particular limitation on a heating method, but there are given a method involving causing the precursor to pass through a heating furnace and a method involving blowing heating air on the precursor. As the heating furnace, there are given, for example, a radiation type heating furnace and a circulation air type heating furnace, and as a device configured to generate heating air, there are given a hot-air blower and a far-infrared heater.

When the heating condition is set to a high temperature and/or a long time period, the hardened region is enlarged, and a region having the highest hardness is shifted from the surface of the elastic member to the position of an inner portion thereof. As the heating condition, it is preferred that at least the surface of the tip end portion of the elastic member be heated at 80° C. or more for 3 minutes or more. Even when the tip end portion of the elastic member is continually heated at a temperature of less than 80° C., the viscosity of the isocyanate compound is not decreased completely to the viscosity required for diffusion in the elastic member. Therefore, the diffusion speed is low, and a large amount of the isocyanate compound is retained on the surface of the elastic member, with the result that the hardness of the surface of the elastic member becomes the highest. As the atmosphere of the heating furnace, it is preferred that the temperature be set to be higher than 80° C. in order to increase the surface temperature of the tip end portion of the elastic member to 80° C. or more.

The temperature and time of the heating treatment vary depending on the impregnation amount of the material for forming a hardened region into the elastic member. Specifically, under the condition in which the elastic member is sufficiently impregnated with the material (for example, the temperature of the material for forming a hardened region is 90° C.), the high hardness region can be formed in the inner portion rather than the surface of the elastic member under the heating furnace condition of 100° C. and 10 minutes. However, under the condition in which the elastic member is not sufficiently impregnated with the material (for example, the temperature of the material for forming a hardened region is 60° C.), the high hardness region is not formed in the inner portion of the elastic member and the surface has the highest hardness under the heating furnace condition of 100° C. and 10 minutes. In this case, it is necessary that the heating furnace condition be 130° C. and 10 minutes or more.

Further, in order to allow a region having a high hardness to be formed easily in the inner portion rather than the surface of the elastic member, it is effective to adjust the mixing ratio of a prepolymer and a hardener used for the elastic member. As a specific blending ratio, it is preferred that the prepolymer and the hardener be mixed so that the molar ratio (α value) of a hydroxyl group with respect to an isocyanate group is 0.45 or more and 0.65 or less. As a state of the elastic member during formation of the hardened region, it is preferred that a larger amount of unreacted isocyanate groups be present in the inner portion of the elastic member. The reason for this is as follows. The isocyanate group present in the surface and inner portion of the elastic member reacts with an isocyanate compound serving as the material for forming a hardened region. Therefore, when a larger amount of the unreacted isocyanate groups are present in the inner portion of the elastic member, the inner portion of the elastic member is more likely to have a high hardness.

Further, even with the above-mentioned mixing ratio, the amount of the remaining isocyanate tends to decrease gradually with time after the molding. Therefore, it is preferred that the hardened region be formed within 6 hours from the manufacture of the elastic member. The amount of the remaining isocyanate can be controlled by the mixing ratio and the time period after the manufacture of the elastic member. The amount of the remaining isocyanate on the surface can be measured by, for example, infrared (IR) absorption spectroscopy. An NCO peak (from about 2,260 $cm^{-1}$ to about 2,270 $cm^{-1}$) of isocyanurate and an aromatic ring peak (about 1,600 $cm^{-1}$) of isocyanate are determined from the obtained IR spectrum, and a ratio (A/B) between an absorbance A of the NCO and an absorbance B of the aromatic ring is defined as an indicator of the amount of the remaining isocyanate. In order to allow the high hardness region to be easily formed in the inner portion rather than the surface, it is preferred that the amount of the remaining isocyanate be 0.2 or more in the measurement of the surface of the elastic member.

[Material for Forming Hardened Region]

The material for forming a hardened region is not particularly limited as long as the material is capable of hardening the elastic member or forming a hardened region on the surface of the elastic member, and examples thereof include an isocyanate compound and an acrylic resin. The material for forming a hardened region may be used by being diluted with a solvent or the like. The solvent to be used for dilution is not particularly limited as long as the solvent dissolves a material to be used, and examples thereof include toluene, xylene, butyl acetate, methyl isobutyl ketone, and methyl ethyl ketone.

When a constituent material of the elastic member is a polyester urethane elastomer, it is more preferred that an isocyanate compound that is a constituent material of the polyester urethane elastomer be used as the material for forming a hardened region in consideration of the compatibility with the elastic member and the impregnating ability with respect to the elastic member. As the isocyanate compound to be brought into contact with the elastic member, an isocyanate compound having one or more isocyanate groups in a molecule can be used. As the isocyanate compound having one isocyanate group in a molecule, an aliphatic monoisocyanate, such as octadecyl isocyanate (ODI), and an aromatic monoisocyanate, such as phenyl isocyanate (PHI), can be used. As the isocyanate compound having two isocyanate groups in a molecule, an isocyanate compound that is generally used for producing a polyurethane resin can be used, and specifically, the following examples can be given: 2,4-tolylene diisocyanate (2,4-TDI), 2,6-tolylene diisocyanate (2,6-TDI), 4,4'-diphenylmethane diisocyanate (MDI), m-phenylene diisocyanate (MPDI), tetramethylene diisocyanate (TMDI), hexamethylene diisocyanate (HDI), and isophorone diisocyanate (IPDI). In addition, as the isocyanate compound having three or more isocyanate groups in a molecule, there may be used, for example, 4,4',4"-triphenylmethane triisocyanate, 2,4,4'-biphenyl triisocyanate, or 2,4,4'-diphenylmethane triisocyanate. Further, as the isocyanate compound having two or more isocyanate groups, a modified derivative thereof, a multimer thereof, or the like can also be used. Of those, in order to efficiently increase the hardness of the hardened region, MDI having high crystallinity, that is, a symmetric structure is preferred. Further, MDI containing a modified derivative is a liquid at room temperature, and hence is more preferred from the viewpoint of workability.

[Hardness of Hardened Region]

In the hardened region in the vicinity of the free end of the elastic member of the present invention, the dynamic hardness of the inner portion is higher than that of a surface of the first surface and/or the second surface. It is necessary that the abutment surface of the elastic member that is brought into abutment against the member to be cleaned be flexible from the viewpoint of stabilizing the contact state with respect to the member to be cleaned. Therefore, a dynamic hardness DHs of the hardened surface is 0.1 ($mN/\mu m^2$) or more and 0.4 ($mN/\mu m^2$) or less.

Further, in order to enhance cleaning performance, a hardened region having a dynamic hardness higher than the dynamic hardness DHs of the surface is formed in the inner portion in the vicinity of the surface of the hardened region in the tip end portion of the elastic member. Specifically, when DHm ($mN/\mu m^2$) represents a maximum value of the dynamic hardness obtained in a positional range in which a distance L from an edge formed of the first surface and the second surface on a straight line that bisects the angle of the edge in a cross-section of the elastic member orthogonal to a longitudinal direction thereof satisfies $0\ \mu m<L\leq 100\ \mu m$, DHm is set to be higher than DHs. With such configuration, the cleaning blade ensures an abutment pressure required when the cleaning blade is brought into abutment against the member to be cleaned, and even when the area (abutment width) of the abutment portion is slightly increased, the peak pressure (abutment pressure per unit area of the abutment portion (pressure obtained by dividing the abutment pressure by the area of the abutment portion)) is not liable to decrease. As a result, excellent cleaning performance is exhibited.

When a maximum value of the dynamic hardness is not present at a position at which the distance L on the straight line falls within a range of $0\ \mu m<L\leq 100\ \mu m$, and a portion having a dynamic hardness higher than DHs is present at a position at which the distance L is more than 100 μm, the abutment width is enlarged excessively when the cleaning blade is brought into abutment against the member to be cleaned, and the peak pressure may not increase.

In the present invention, the dynamic hardness of the inner portion of the free end of the elastic member is measured at a position on the straight line that bisects the angle of the edge formed of the first surface and the second surface in the cross-section orthogonal to the elastic member in the longitudinal direction thereof, with the edge being a starting point. The reasons for this are as follows. The measurement surface of the dynamic hardness DHs is at least one of the first surface and the second surface, and the direction of the angle can be regarded as the substantial thickness direction of the cleaning blade in regard to the positional relationship with the member to be cleaned during cleaning as illustrated in FIG. 3.

When the dynamic hardness DHs of the hardened surface is larger than 0.4, the hardness of the surface is excessively large, and hence edge chipping may occur. When the dynamic hardness DHs of the hardened surface is less than 0.1, even when the hardness of the inner portion in the vicinity of the surface is large, the abutment width becomes excessively large to decrease the peak pressure, and cleaning performance may be degraded. A more preferred value of the dynamic hardness DHs falls within a range of from 0.12 to 0.35.

It is more preferred that the position representing DHm on the straight line be present at a position where the distance L from the edge falls within a range of 20 μm or more and 100 μm or less. When the position representing DHm is present at a position where the distance from the edge falls within a range of from 20 μm to 100 μm, the occurrence of edge chipping can be more effectively suppressed. It is more preferred that the position representing DHm be present at a position where the distance from the edge falls within a range of from 20 μm to 80 μm.

Further, when DHm represents a maximum value of the dynamic hardness on the straight line that bisects the angle forming the edge of the cross-section orthogonal to the elastic member in the longitudinal direction thereof, and $P_{max}$ (μm) represents a distance from the edge, it is still more preferred that the dynamic hardness gradually increase from the edge to the position of $P_{max}$. When the hardness gradually increases in this manner, a region having an extremely high hardness is not present at a position of 20 μm from the surface, and hence edge chipping is not liable to occur during long-term use.

It is preferred that DHm be 1.1 times or more of the dynamic hardness DHs of the hardened surface. When DHm is 1.1 times or more of DHs, the abutment pressure to the member to be cleaned can be applied more reliably.

It is preferred that DHm be 10 times or less of DHs. When DHm is 10 times or less of DHs, the hardness of the hardened region of the inner portion of the abutment surface is not excessively large, and hence the rubber elasticity of the tip end portion of the elastic member is not liable to be impaired. A still more preferred range of DHm is 1.2 times or more and 8 times or less of DHs.

It is more preferred that the hardened region be formed on both the first surface and the second surface that form the edge of the elastic member to be brought into abutment against the member to be cleaned. This is because both the first surface and the second surface may be brought into contact with the member to be cleaned during cleaning in some cases as shown in FIG. 3.

[Method of Measuring Hardness of Hardened Region]

In the present invention, the hardness of the hardened region can be measured by the following method. As a measurement device, "Shimadzu dynamic ultra micro hardness tester DUH-W211S" manufactured by Shimadzu Corporation can be used. As an indenter, a 115° triangular pyramidal indenter is used, and a dynamic hardness can be determined by the following calculation expression.

Dynamic hardness: $DH=\alpha\times P/D^2$ where α represents a constant of an indenter shape, P represents a test force (mN), and D represents a penetration amount (penetration depth) (μm) of the indenter into a sample.

The measurement conditions are as follows.

α: 3.8584

P: 1.0 mN

Load rate: 0.03 mN/sec

Retention time: 5 seconds

Measurement environment: temperature of 23° C., relative humidity of 55%

Figure 5:
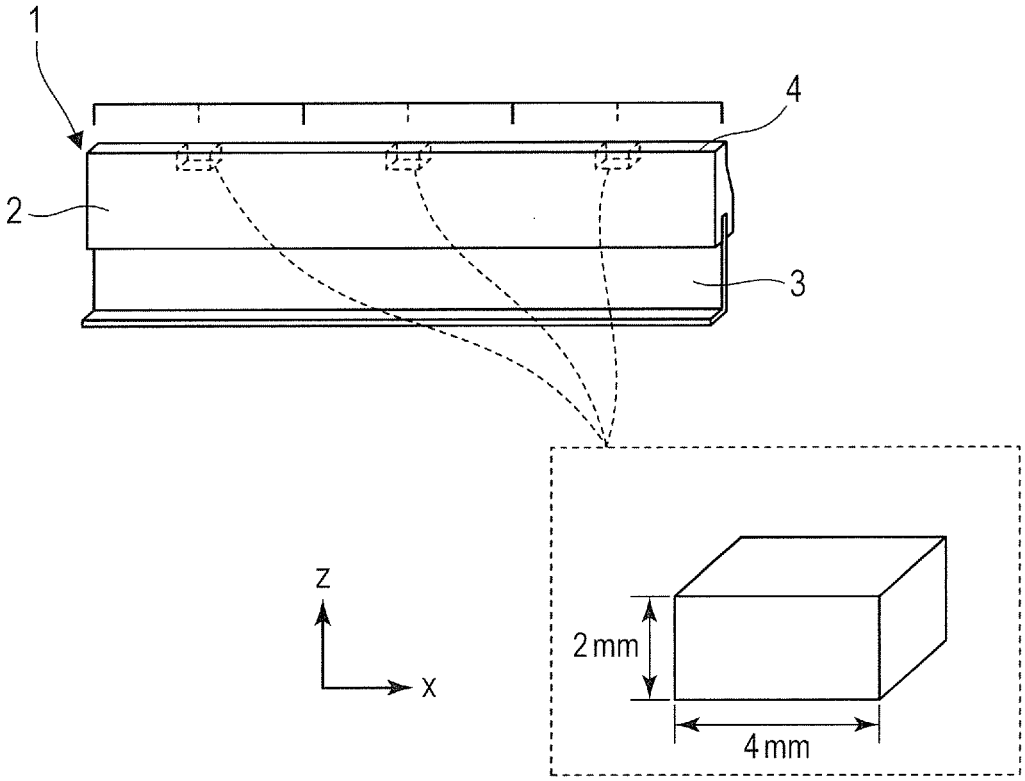
FIG. 5 is a view for illustrating a cut portion of a measurement sample.

Aging of measurement sample: left in an environment of a temperature of 23° C. and a relative humidity of 55% for 6 hours or more A method of preparing a measurement sample is as follows. The measurement sample is cut out with dimensions of 4 mm in a longitudinal direction from each of intermediate points (three points) at three positions obtained by equally dividing the image forming area in the longitudinal direction (2 mm from the intermediate point in both directions) and 2 mm from an edge 7 in the transverse direction (see FIG. 5).

Figure 6A:
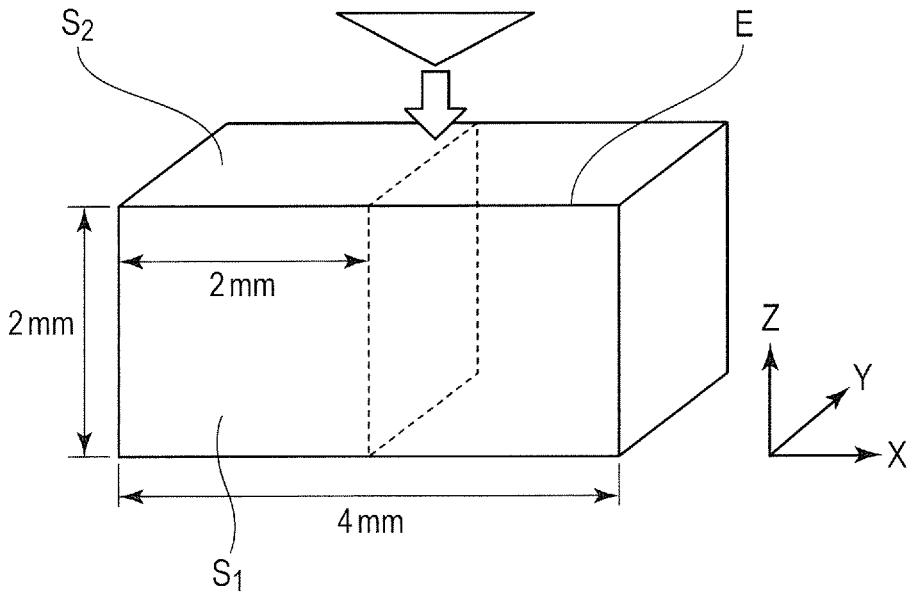
FIG. 6A is a view for illustrating the measurement of a dynamic hardness of the hardened surface.

A measurement sample is placed so that the indenter is perpendicularly brought into contact with the hardened surface (first surface, second surface) of the hardened region of the measurement sample, and the dynamic hardness DHs of the hardened surface is measured at a position of 2 mm from the end portion in the longitudinal direction and a position away from the edge by 100 μm or more and 500 μm or less in the transverse direction or the thickness direction. FIG. 6A is a view for illustrating the arrangement in which the measurement sample is placed so that the indenter is perpendicularly brought into contact with a second surface $S_2$ of the measurement sample. This measurement is performed for three measurement samples, and an average value thereof is defined as a dynamic hardness $DHs_2$ of the surface of the second surface $S_2$. Similarly, the three measurement samples are placed so that the indenter is perpendicularly brought into contact with a first surface $S_1$ of each measurement sample, and an average value of the measurement values of the three measurement samples is defined as a dynamic hardness $DHs_1$ of the surface of the first surface $S_1$. A higher value of the dynamic hardness $DHs_1$ of the surface of the first surface $S_1$ and the dynamic hardness $DHs_2$ of the surface of the second surface $S_2$ is defined as the dynamic hardness DHs (mN/μm$^2$) of the hardened surface.

Figure 6B:
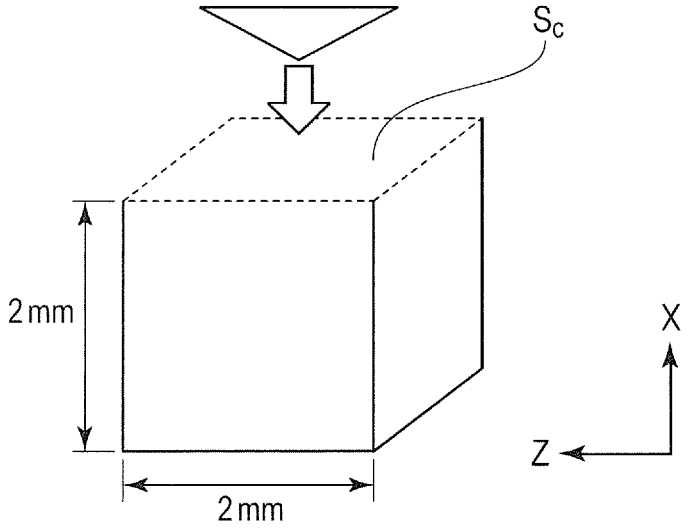
FIG. 6B is a view for illustrating the measurement of a dynamic hardness of a cross-section of the elastic member orthogonal to the longitudinal direction thereof.
Figure 7:
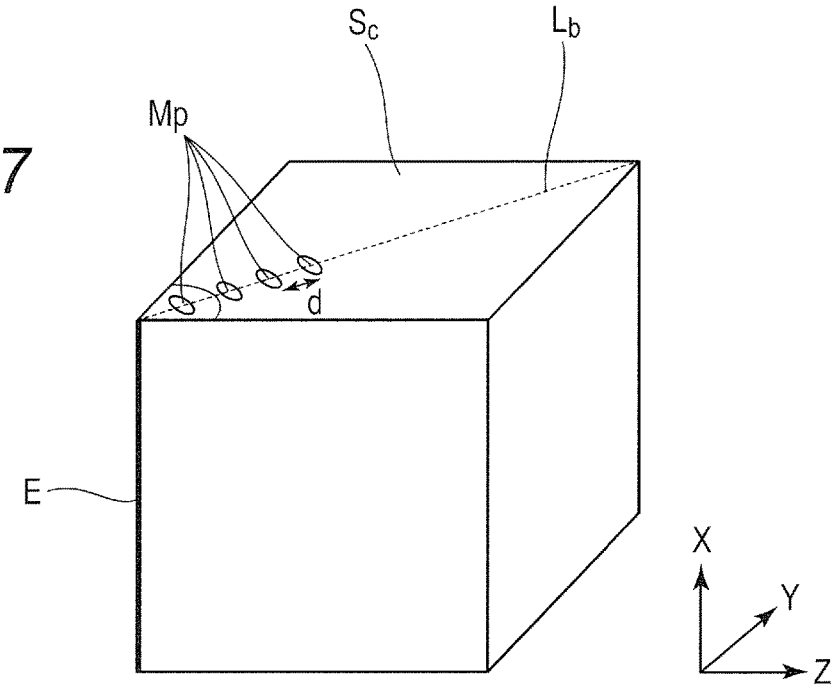
FIG. 7 is a view for illustrating a measurement portion of a dynamic hardness in the cross-section of the elastic member orthogonal to the longitudinal direction thereof.

The dynamic hardness of the inner portion in the vicinity of the surface of the hardened region in the tip end portion of the elastic member in the cross-section orthogonal to the elastic member in the longitudinal direction thereof is measured by the following procedure. Each measurement sample after the above-mentioned measurement is cut at a position of 2 mm in the longitudinal direction and placed so that the indenter is perpendicularly brought into contact with a cut surface $S_c$ (see FIG. 6B). Measurement positions Mp are defined as positions on a straight line $L_b$ that bisects the angle of an edge E, at which a measurement interval d is 10 μm in regard to the distance L from the edge E (see FIG. 7). Measurement is performed successively at each measurement position Mp and continuously performed until a measurement value reaches the dynamic hardness of the elastic member in which the hardened region is not formed. This measurement is performed for three measurement samples, and an average value thereof is defined as the dynamic hardness of the inner portion of the free end. A maximum value of those measurement values of the dynamic hardness is represented by DHm (mN/μm$^2$).

Method of Manufacturing Cleaning Blade

[Manufacturing of Precursor of Cleaning Blade]

A method of manufacturing a cleaning blade according to the present invention may be selected from any suitable known methods and is not particularly limited. Further, a method of manufacturing an elastic member may be selected from any suitable known methods such as a molding method and a centrifugal molding method. For example, a supporting member in which an adhesive is applied to a contact portion with respect to an elastic member is placed into a mold for a cleaning blade with a cavity for forming the elastic member. Meanwhile, a prepolymer obtained by partially polymerizing a polyisocyanate and a polyol and a hardener containing a polyol, a chain extender, a catalyst, and other additives are loaded into a casting machine, and mixed and stirred at a predetermined ratio in a mixing chamber, to thereby prepare a raw material composition such as a polyurethane elastomer. The raw material composition is injected into the mold to form a hardened molded article (elastic member) on the surface of the supporting member having the adhesive applied thereto, followed by demolding after reaction hardening. As necessary, the hardened molded article is appropriately cut in order to ensure a predetermined dimension of the elastic member and the accuracy of a dimension of an edge of an abutment portion of the elastic member, to thereby manufacture a precursor of a cleaning blade having the supporting member and the elastic member molded integrally.

When an elastic member is manufactured by a centrifugal molding machine, a raw material composition such as a polyurethane elastomer, which is obtained by mixing and stirring a prepolymer obtained by partially polymerizing a polyisocyanate and a polyol and a hardener containing a polyol, a chain extender, a catalyst, and other additives, is loaded into a rotating drum, to thereby prepare a polyurethane elastomer sheet. The polyurethane elastomer sheet is cut in order to ensure a predetermined dimension and the accuracy of a dimension of an edge of an abutment portion of the elastic member. The polyurethane elastomer sheet (elastic member) thus obtained is bonded onto a supporting member having an adhesive applied thereto, to thereby manufacture a precursor of a cleaning blade.

[Formation of Hardened Region]

A hardened region can be formed by the method described above. That is, first, a material for forming a hardened region is applied onto, for example, a first surface and a second surface of a tip end portion of the elastic member of the precursor of the cleaning blade. Then, the tip end portion of the elastic member is subjected to heating treatment, for example, at a temperature of 80° C. or more for 3 minutes or more. With this, a hardened region can be formed on the surface and inner portion of the tip end portion of the elastic member.

When it is necessary to cut the elastic member in order to form an edge to be brought into abutment against the member to be cleaned on the cleaning blade, the hardened region may formed before or after the cutting. In the case of centrifugal molding, the hardened region may also be formed before the elastic member is connected to the supporting member. In the manner described above, the cleaning blade can be obtained.

<Process Cartridge and Electrophotographic Image Forming Apparatus>

The cleaning blade according to the present invention may be used by being incorporated into a process cartridge for an electrophotographic image forming apparatus. The cleaning blade according to the present invention may also be used by being incorporated into an electrophotographic image forming apparatus.

Figure 9:
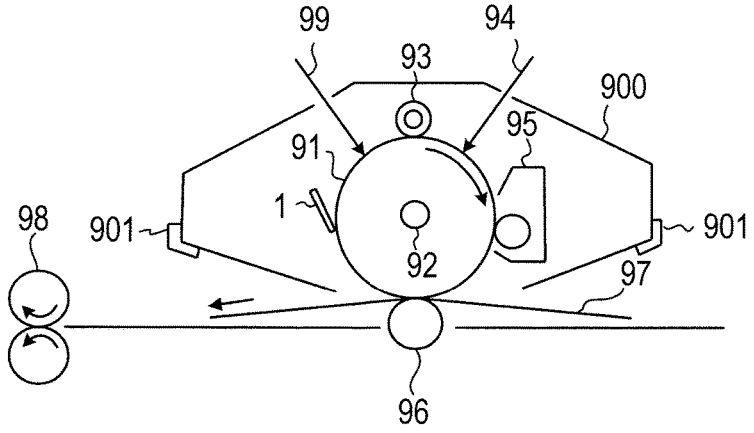
FIG. 9 is a schematic drawing showing a constitution example of an electrophotographic image forming apparatus according to an embodiment of the present invention.

FIG. 9 is a schematic drawing showing a constitution example of the electrophotographic image forming apparatus according to an embodiment of the present invention. The embodiment of the electrophotographic image forming apparatus shown in FIG. 9 includes the process cartridge according to an embodiment of the present invention.

In FIG. 9, a cylindrical electrophotographic photosensitive member 91 is rotationally driven with an axis 92 as the center on the arrow direction (the clockwise direction) at a predetermined circumferential velocity.

The surface (peripheral surface) of the electrophotographic photosensitive member 91 driven rotationally is charged with positive potential or negative potential by a charging device 93, and subsequently exposed to exposure light (image exposure light) 94 output from the image exposing device (not shown in Figure). Thus, an electrostatic latent image corresponding to an intended image is formed on the surface of the electrophotographic photosensitive member 91.

The electrostatic latent image formed on the surface of the electrophotographic photosensitive member 91 is developed by a developing device 95 with the use of a toner stored in the developing device 95, and formed into a toner image.

The toner image formed on the surface of the electrophotographic photosensitive member 91 is sequentially transferred to a transfer medium (paper or the like) 97 by a transfer device 96.

The transfer medium 97 on which the toner image is transferred is separated from the surface of the electrophotographic photosensitive member 91, introduced to a fixing device 98, subjected to image fixation, and thereby printed out as an image formation (print, copy) outside of the electrophotographic apparatus.

A cleaning blade 1 as the cleaning device removes the transfer residual toner from the surface of the electrophotographic photosensitive member 91 after transferring the toner image in accordance with the rotation of the electrophotographic photosensitive member while contacting with the surface of the electrophotographic photosensitive member 91 at a predetermined linear pressure. Thereafter, the electrophotographic photosensitive member 91 is charge eliminated by pre-exposure light 99 from a pre-exposing device (not shown in Figure), and used repeatedly for image formation.

Among the components selected from the electrophotographic photosensitive member 91, the charging device 93, the developing device 95, the transfer device 96 and the cleaning blade 1 as the cleaning device, plural components including the electrophotographic photosensitive member 91 are stored in a vessel, and united and constituted integrally as a process cartridge, which may be constituted detachably attachable to the electrophotographic image forming apparatus body. In FIG. 9, the electrophotographic photosensitive member 91, the charging device 93, the developing device 95 and the cleaning blade 1 as the cleaning device are integrally supported and made into a cartridge, and regarded as a process cartridge 900, which is detachably attachable to the electrophotographic image forming apparatus body by using a guide device 901 such as a rail provided in the electrophotographic image forming apparatus body.

EXAMPLES

Now, the present invention is described by way of manufacturing examples, Examples, and Comparative Examples, but the present invention is not limited to those examples. As raw materials other than those described in Examples and Comparative Examples, reagents or industrial reagents were used.

Example 1

In this Example, an integrally molded cleaning blade of FIG. 1A was manufactured and evaluated.

1. Supporting Member

A zinc-coated steel plate having a thickness of 1.6 mm was prepared and processed, thereby the supporting member 3 having an L-shaped cross-section illustrated in FIG. 2 was prepared. An adhesive (trade name: Chemlok 219, manufactured by LORD Corporation) for adhesion of a polyurethane resin was applied onto a portion of the supporting member that an elastic member was brought into contact with.

2. Preparation of Raw Material for Elastic Member

Materials of the kinds and amounts shown in the row "Component 1" of Table 1 were reacted by stirring at 80° C. for 3 hours, thereby a prepolymer containing an isocyanate in a mol concentration of 8.50% was prepared. Then, 212.9 g of a hardener containing materials of the kinds and amounts shown in the row "Component 2" of Table 1 was mixed with 1,000 g of the prepolymer to prepare a polyurethane elastomer composition containing a hydroxyl group in a molar ratio ($\alpha$ value) of 0.60 with respect to an isocyanate group, and the polyurethane elastomer composition was defined as a raw material for an elastic member.

TABLE 1

| | Abbreviation symbol | Material | Usage amount (g) |
|---|---|---|---|
| Component 1 | MDI | 4,4'-Diphenylmethane diisocyanate (trade name: MILLIONATE MT, manufactured by Tosoh Corporation) | 321.2 |
| | PBA | Polybutylene adipate polyester polyol having a number-average molecular weight of 2,500 | 678.8 |
| Component 2 | PHA | Polyhexylene adipate polyester polyol having a number-average molecular weight of 1,000 | 161.6 |
| | 14BD | 1,4-Butanediol | 28.1 |
| | TMP | Trimethylolpropane | 22.9 |
| | Catalyst A | Polycat 46 (trade name, manufactured by Air Products and Chemicals, Inc.) | 0.07 |
| | Catalyst B | N,N-Dimethylaminohexanol (trade name: KAOLIZER No. 25, manufactured by Kao Corporation) | 0.3 |

3. Integral Molding of Supporting Member and Elastic Member

The polyurethane elastomer composition was injected into a mold for a cleaning blade in which the portion of the supporting member having the adhesive applied thereto was arranged so as to project into a cavity and hardened at 130° C. for 2 minutes, followed by demolding, thereby an integrally molded article of the elastic member and the supporting member was prepared.

The integrally molded article was appropriately cut before a hardened region was formed so as to have an edge angle of 90° and distances of the elastic member in the transverse direction (lower surface 5), the thickness direction (vertical surface 6), and the longitudinal direction of 7.5 mm, 1.8 mm, and 240 mm, respectively.

4. Formation of Hardened Region

Modified MDI (trade name: MILLIONATE MTL, manufactured by Tosoh Corporation) was provided as a material for forming a hardened region. The material for forming a hardened region was heated to 80° C., and the integrally molded elastic member was immersed into the material for 20 seconds so that five surfaces other than a surface 11 (FIG. 2) on a side opposed to the supporting member were immersed into the material, to thereby apply the material onto each surface. Then, the material for forming a hardened region on the surfaces of the elastic member was wiped off with a sponge soaked with butyl acetate serving as a solvent. Then, the elastic member was subjected to heat treatment at a temperature of 130° C. for 40 minutes in an electric furnace so that the material for forming a hardened region that was impregnated into the elastic member diffused to the inner portion of the elastic member to be hardened. Thus, a cleaning blade 1, in which the hardened region was formed on the five surfaces (first surface, second surface, surface opposed to the first surface, and both end surfaces in the longitudinal direction) of the elastic member and the inner portions of those surfaces, was obtained. The hardened region was formed 1 hour after the molding of the elastic member.

Figure 4:
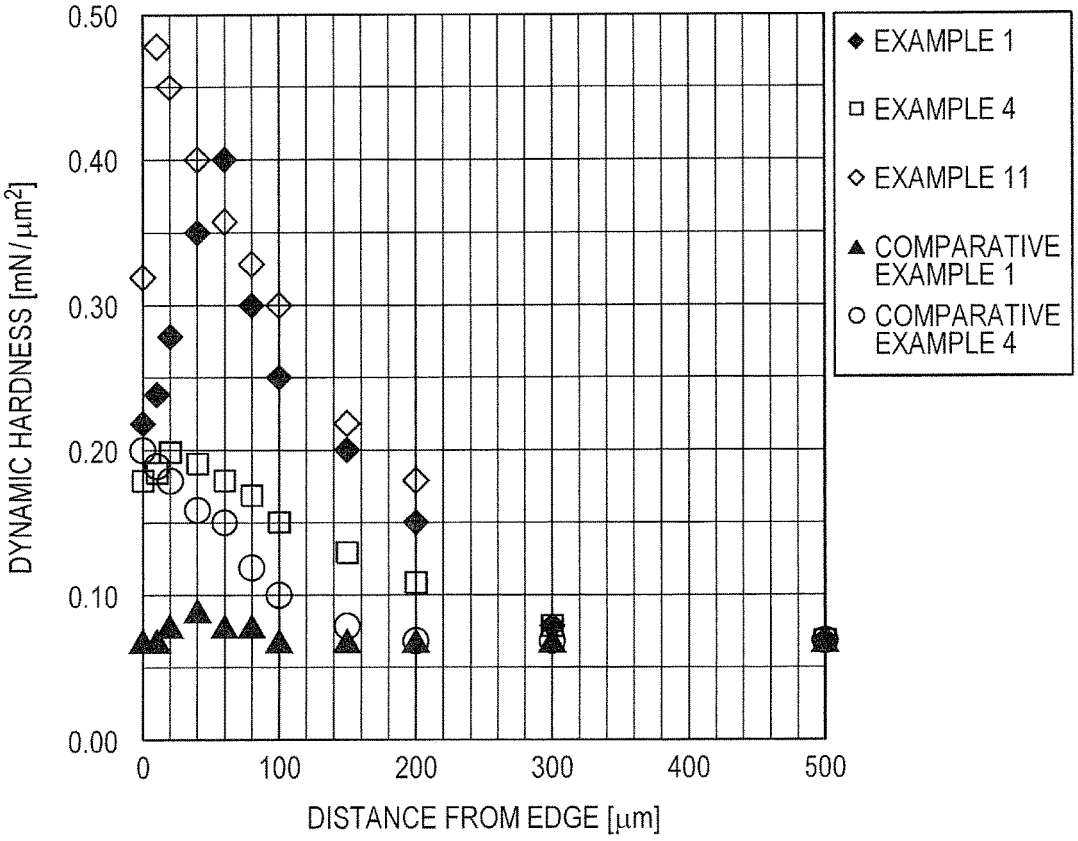
FIG. 4 is a graph for showing a dynamic hardness of a hardened surface and an inner portion of an elastic member in Examples 1, 4, and 11 and Comparative Examples 1 and 4.

The obtained cleaning blade was evaluated by the following method. The results of each evaluation are shown in Table 4. In addition, a dynamic hardness of a hardened surface and an inner portion of the obtained cleaning members in Examples 1, 4, and 11 and Comparative Examples 1 and 4 is shown in FIG. 4.

<1. Measurement of Hardness of Hardened Region>

The first surface and the second surface were measured for hardness by the above-mentioned method of measuring a hardness of a hardened region, to thereby determine the dynamic hardness DHs. The maximum value DHm of the dynamic hardness was also measured.

<2. Evaluation of Cleaning Performance>

The cleaning blade 1 was incorporated, as a cleaning blade of a photosensitive drum serving as a member to be cleaned, into a black cartridge of a color laser beam printer (trade name: HP LaserJet Enterprise Color M553dn, manufactured by Hewlett-Packard Company). Then, images were formed on 12,500 sheets that were able to be printed under a low-temperature and low-humidity environment (temperature of 15° C. and relative humidity of 10%) (hereinafter referred to as "normal evaluation"). Further, a developing device was replaced by a developing device of a new black cartridge, and images were formed again on 12,500 sheets that were able to be printed (hereinafter referred to as "twice evaluation"). Further, evaluation was made while a waste toner was appropriately sucked out through a hole opened in a cartridge back surface. The obtained images were ranked in regard to the performance based on the following evaluation criteria.

A: An image defect (image streak) caused by the cleaning blade does not occur in the normal evaluation or the twice evaluation.

B: An image defect (image streak) caused by the cleaning blade does not occur in the normal evaluation but slightly occurs in the twice evaluation. However, there are no problems for practical use.

C: An image defect (image streak) caused by the cleaning blade does not occur in the normal evaluation but occurs in the twice evaluation.

D: An image defect (image streak) caused by the cleaning blade slightly occurs both in the normal evaluation and in the twice evaluation. However, there are no problems for practical use.

E: An image defect (image streak) caused by the cleaning blade occurs both in the normal evaluation and in the twice evaluation.

<3. Evaluation of Edge Chipping of Cleaning Blade>

Figure 8:
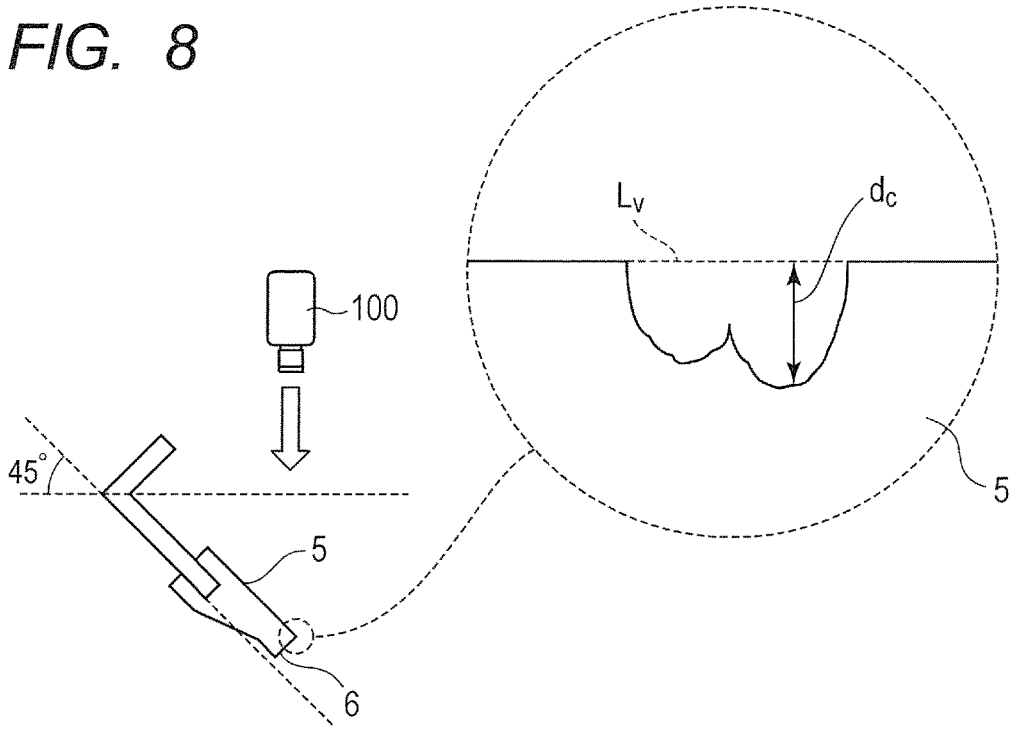
FIG. 8 is a view for illustrating a method of measuring edge chipping.

After the completion of the above-mentioned cleaning performance evaluation (twice evaluation), the cleaning blade was removed from the cartridge and observed under magnification of 1,000 times with a digital microscope 100 (trade name: VHX-5000 (main body) and VH-ZST (lens), manufactured by Keyence Corporation). The entire region of the cleaning blade in the longitudinal direction was observed under a state in which the tip end portion of the first surface (lower surface 5) of the elastic member of the cleaning blade was set to an observation surface, and the cleaning blade was arranged at a position of being obliquely tilted by 45° so that the supporting member was directed upward and the tip end portion of the elastic member was directed downward as illustrated in FIG. 8. As illustrated in a partially enlarged view surrounded by the broken circular frame of FIG. 8 (observation view under magnification of 1,000 times), a maximum value of the distance of an edge chipping portion in the transverse direction was measured as an "edge chipping amount $d_c$", and the performance was ranked based on the following evaluation criteria. More specifically, the edge chipping amount $d_c$ refers to a distance between a virtual line $L_v$ obtained by assuming that the edge was not chipped and a portion of the edge chipping portion that was chipped most.

A: Edge chipping does not occur.

B: Edge chipping amount is less than 2 μm.

C: Edge chipping amount is 2 μm or more and less than 5 μm.

D: Edge chipping amount is 5 μm or more.

<4. Comprehensive Evaluation>

Based on the ranking of the image evaluation of cleaning performance and the ranking of the evaluation results of the edge chipping evaluation of the cleaning blade, comprehensive evaluation was made as follows.

A: Evaluation results are a combination of A/A, A/B, or B/A.

B: Evaluation results are a combination of A/C, C/A, B/B, B/C, or C/B.

C: Evaluation results are a combination of C/C.

D: Evaluation results include one or more D with no E.

E: Evaluation results include one or more E.

<5. Turn-up Evaluation of Cleaning Blade (Reference)>

In the above-mentioned evaluation of cleaning performance, no turn-up and abnormal noise occurred, but turn-up evaluation of the cleaning blade under an environment that was severer than that in normal use was made for reference as follows.

The cleaning blade of this Example was incorporated, as a cleaning blade for a photosensitive drum serving as a member to be cleaned, into a new black cartridge different from that in the evaluation of cleaning performance, and images were formed on 10,000 sheets under a high-temperature and high-humidity environment (temperature of 30° C. and relative humidity of 80%). After that, the cartridge having a developing device removed therefrom was set in an idling machine (a device including a jig configured to hold a cartridge while rotating a photosensitive drum). Under the same environment, the photosensitive drum was idled at a rotation speed of 170 rpm, and the state of the tip end portion of the cleaning blade was observed for 10 minutes. The tip end portion of the cleaning blade was observed by processing the cartridge and setting a CCD camera or the like. The performance was ranked based on the following evaluation criteria.

A: Neither turn-up nor abnormal noise (chattering noise) occurs.

B: No turn-up occurs, but abnormal noise (chattering noise) occurs.

C: Turn-up occurs.

Examples 2 to 7, 10 to 12, and 15 to 16

Cleaning blades 2 to 7, 10 to 12, and 15 to 16, in which a hardened region was formed on five surfaces of an elastic member and inner portions of those surfaces, were obtained in the same manner as in Example 1 except that the temperature, immersion time, and heating condition (temperature and time) of a material for forming a hardened region, and an elapsed time after molding of the elastic member, in formation of the hardened region, were changed to the conditions shown in Table 2. Evaluation results are shown in Table 4.

Example 8

The temperature, immersion time, and heating condition (temperature and time) of the material for forming a hardened region, in formation of the hardened region, were changed to the conditions shown in Table 2. Four surfaces (first surface, second surface, and both end surfaces in the longitudinal direction) were defined as the immersion surfaces in formation of the hardened region. A cleaning blade 8 including a hardened region on those four surfaces and inner portions of those surfaces was obtained in the same manner as in Example 1 except for the foregoing. Evaluation results are shown in Table 4.

Example 9

A hardened region was formed on five surfaces of an integrally molded article and inner portions of those surfaces in the same manner as in Example 1 except that the temperature, immersion time, and heating condition (temperature and time) of a material for forming a hardened region in formation of the hardened region were changed to the conditions shown in Table 2. Then, the integrally molded article was cooled, and both end portions of the elastic member were cut so that the distance in the longitudinal direction was set to 240 mm. Thus, a cleaning blade 9, in which a hardened region was formed on three surfaces (first surface, second surface, and surface opposed to the first surface) and inner portions of those surfaces, was obtained. Evaluation results are shown in Table 4.

Example 13

An integrally molded article of a supporting member and an elastic member was manufactured in the same manner as in Example 1. A material for forming a hardened region as the same as that of Example 1 was heated to 70° C., and a spray discharge amount thereof was set to 20 mg for 2 seconds. Then, the material for forming a hardened region was sprayed onto a lower surface (first surface; a region at a distance of 3 mm from an edge in the Z direction) of the tip end portion of the elastic member while the elastic member was moved at 50 mm/s. Then, the integrated molded article was left to stand under an environment of a temperature of 25° C. and a relative humidity of 50% for 10 minutes, and subjected to heat treatment in an electric furnace at a temperature of 180° C. for 3 minutes. Next, the integrally molded article was cooled, and the elastic member was cut so as to have predetermined dimensions in the transverse direction and the longitudinal direction, thereby a cleaning blade 13 was prepared. A hardened region was formed only on the lower surface (first surface) of the elastic member. Evaluation results are shown in Table 4.

Example 14

An integrally molded article of a supporting member and an elastic member was manufactured in the same manner as in Example 1. Then, before a hardened region was formed, the elastic member was cut so as to have a predetermined dimension in the transverse direction. Then, a material for forming a hardened region as the same as that of Example 1 was heated to 80° C., and an application amount thereof was set so as to be 18 mg for 20 droplets. Then, the material for forming a hardened region was applied onto a vertical surface (second surface) of the elastic member through use of a dispenser while the elastic member was moved at 100 mm/s. Then, the integrally molded article was left to stand under an environment of a temperature of 25° C. and a relative humidity of 50% for 10 minutes, and subjected to heat treatment in an electric furnace at a temperature of 130° C. for 30 minutes. Next, the integrally molded article was cooled, and the elastic member was cut so as to have a distance of 240 mm in the longitudinal direction, thereby a cleaning blade 14 was prepared. A hardened region was formed only on the vertical surface (second surface) of the elastic member. Evaluation results are shown in Table 4. Differences between the manufacturing conditions of Examples 13 and 14 are shown in Table 3.

Comparative Example 1

This Comparative Example is an example in which a hardened region is not formed on an elastic member. An integrally molded article of a supporting member and an elastic member was manufactured in the same manner as in Example 1. Then, the elastic member was cut so as to have a dimension of 7.5 mm in the transverse direction and a dimension of 240 mm in the longitudinal direction, thereby a cleaning blade 21 was prepared. Evaluation results are shown in Table 4.

Comparative Examples 2 and 3

Cleaning blades 22 and 23, in which a hardened region was formed on five surfaces of an elastic member and inner portions of those surfaces, were obtained in the same manner as in Example 1 except that the temperature, immersion time, and heating condition (temperature and time) of a material for forming a hardened region, and an elapsed time after molding of the elastic member, in formation of the hardened region, were changed to the conditions shown in Table 2. Evaluation results are shown in Table 4.

Comparative Example 4

The temperature and immersion time of a material for forming a hardened region in formation of the hardened region were changed to the conditions shown in Table 2. The heating treatment was not performed. A cleaning blade 24, in which a hardened region was formed on five surfaces of the elastic member and inner portions of those surfaces, was obtained in the same manner as in Example 1. The hardened region was formed after an elapse of 24 hours from molding of the elastic member. Evaluation results are shown in Table 4.

TABLE 2

| | | Example | | | | | | | | |
|---|---|---|---|---|---|---|---|---|---|---|
| | | 1 | 2 | 3 | 4 | 5 | 6 | 7 | 8 | 9 |
| Number of immersion application surfaces | | 5 surfaces | 5 surfaces | 5 surfaces | 5 surfaces | 5 surfaces | 5 surfaces | 5 surfaces | 4 surfaces | 5 surfaces |
| Removal of end surfaces in longitudinal direction | | — | — | — | — | — | — | — | — | Yes |
| Number of hardening treatment surfaces of elastic member | | 5 surfaces | 5 surfaces | 5 surfaces | 5 surfaces | 5 surfaces | 5 surfaces | 5 surfaces | 4 surfaces | 3 surfaces |
| Temperature of material for forming hardened region | ° C. | 80 | 80 | 60 | 80 | 80 | 80 | 70 | 80 | 80 |
| Immersion time | Seconds | 20 | 20 | 10 | 5 | 60 | 40 | 20 | 20 | 20 |
| Heat treatment temperature | ° C. | 130 | 110 | 140 | 120 | 130 | 180 | 110 | 130 | 130 |

TABLE 2-continued

| | | | | | | | | | | |
|---|---|---|---|---|---|---|---|---|---|---|
| Heat treatment time | Minutes | 40 | 30 | 40 | 30 | 30 | 5 | 120 | 30 | 30 |
| Elapsed time after molding of elastic member during formation of hardened region | Hours | 1 | 3 | 3 | 6 | 1 | 3 | 1 | 1 | 1 |

| | | Example | | | | | Comparative Example | | | |
|---|---|---|---|---|---|---|---|---|---|---|
| | | 10 | 11 | 12 | 15 | 16 | 1 | 2 | 3 | 4 |
| Number of immersion application surfaces | | 5 surfaces | 5 surfaces | 5 surfaces | 5 surfaces | 5 surfaces | 0 | 5 surfaces | 5 surfaces | 5 surfaces |
| Removal of end surfaces in longitudinal direction | | — | — | — | — | — | — | — | — | — |
| Number of hardening treatment surfaces of elastic member | | 5 surfaces | 5 surfaces | 5 surfaces | 5 surfaces | 5 surfaces | 0 | 5 surfaces | 5 surfaces | 5 surfaces |
| Temperature of material for forming hardened region | ° C. | 70 | 80 | 70 | 75 | 90 | — | 80 | 60 | 60 |
| Immersion time | Seconds | 20 | 40 | 60 | 30 | 30 | — | 30 | 5 | 10 |
| Heat treatment temperature | ° C. | 110 | 180 | 180 | 130 | 130 | — | 110 | 140 | — |
| Heat treatment time | Minutes | 180 | 3 | 3 | 180 | 20 | — | 10 | 30 | — |
| Elapsed time after molding of elastic member during formation of hardened region | Hours | 1 | 1 | 1 | 1 | 6 | — | 1 | 6 | 24 |

TABLE 3

| | Example 13 | Example 14 |
|---|---|---|
| Application surface | Only lower surface (first surface) | Only vertical surface (second surface) |
| Number of hardening treatment surfaces of elastic member | 1 surface | 1 surface |
| Application method | Spray application | Dispenser application |

TABLE 3-continued

| | | Example 13 | Example 14 |
|---|---|---|---|
| Heat treatment temperature | ° C. | 180 | 130 |
| Heat treatment time | Minutes | 3 | 30 |
| Elapsed time after molding of elastic member during formation of hardened region | Hours | 1 | 1 |

TABLE 4

| | Example | | | | | | |
|---|---|---|---|---|---|---|---|
| | Example 1 | Example 2 | Example 3 | Example 4 | Example 5 | Example 6 | Example 7 |
| Dynamic hardness DHs | 0.22 | 0.40 | 0.10 | 0.18 | 0.24 | 0.30 | 0.13 |
| Maximum value DHm of dynamic hardness within range of from 20 μm to 100 μm from edge | 0.40 | 0.50 | 0.15 | 0.20 | 2.35 | 0.35 | 0.30 |
| DHm/DHs | 1.8 | 1.3 | 1.5 | 1.1 | 9.8 | 1.2 | 2.3 |
| Pmax (μm) | 60 | 40 | 60 | 20 | 40 | 20 | 100 |

TABLE 4-continued

| | | | | | | | | |
|---|---|---|---|---|---|---|---|---|
| | Maximum value of dynamic hardness in hardened region | 0.40 | 0.50 | 0.15 | 0.20 | 2.35 | 0.35 | 0.30 |
| | Distance from edge to a position in which dynamic hardness is maximum in hardened region | 60 | 40 | 60 | 20 | 40 | 20 | 100 |
| | Treatment surfaces in image forming area | 3 surfaces | 3 surfaces | 3 surfaces | 3 surfaces | 3 surfaces | 3 surfaces | 3 surfaces |
| | End surface treatment (outside of image forming area) | Yes | Yes | Yes | Yes | Yes | Yes | Yes |
| | Presence or absence of gradual increase from edge to position of Pmax | Present | Present | Present | Present | Present | Present | Present |
| | Amount of remaining isocyanate of elastic member | 0.8 | 0.5 | 0.5 | 0.2 | 0.8 | 0.5 | 0.8 |
| | Surface hardness of lower surface (first surface) | 0.22 | 0.39 | 0.10 | 0.18 | 0.24 | 0.30 | 0.13 |
| | Surface hardness of vertical surface (second surface) | 0.21 | 0.40 | 0.10 | 0.18 | 0.23 | 0.30 | 0.12 |
| | Internal dynamic hardness at position 10 μm from edge | 0.24 | 0.42 | 0.11 | 0.19 | 1.00 | 0.31 | 0.14 |
| | Internal dynamic hardness at position 20 μm from edge | 0.28 | 0.45 | 0.12 | 0.20 | 1.85 | 0.35 | 0.16 |
| | Internal dynamic hardness at position 40 μm from edge | 0.35 | 0.50 | 0.14 | 0.19 | 2.35 | 0.32 | 0.18 |
| | Internal dynamic hardness at position 60 μm from edge | 0.40 | 0.42 | 0.15 | 0.18 | 2.05 | 0.28 | 0.22 |
| | Internal dynamic hardness at position 80 μm from edge | 0.30 | 0.35 | 0.12 | 0.17 | 1.60 | 0.21 | 0.26 |
| | Internal dynamic hardness at position 100 μm from edge | 0.25 | 0.25 | 0.10 | 0.15 | 0.82 | 0.12 | 0.30 |
| | Internal dynamic hardness at position 150 μm from edge | 0.20 | 0.18 | 0.09 | 0.13 | 0.40 | 0.09 | 0.20 |
| | Internal dynamic hardness at position 200 μm from edge | 0.15 | 0.15 | 0.08 | 0.11 | 0.22 | 0.07 | 0.15 |
| | Internal dynamic hardness at position 300 μm from edge | 0.08 | 0.08 | 0.07 | 0.08 | 0.10 | 0.08 | 0.08 |
| | Internal dynamic hardness at position 500 μm from edge | 0.07 | 0.07 | 0.08 | 0.07 | 0.08 | 0.07 | 0.07 |
| Evaluation (LBP endurance) | Cleaning performance | A | B | B | B | B | B | B |
| | Presence or absence of edge chipping | A | B | A | A | B | B | A |
| | Comprehensive evaluation | A | B | A | A | B | B | A |

TABLE 4-continued

| Evaluation for reference (idling) | Turn-up evaluation | A | A | A | A | A | A | A |
|---|---|---|---|---|---|---|---|---|

| | Example | | | | | | |
|---|---|---|---|---|---|---|---|
| | Example 8 | Example 9 | Example 10 | Example 11 | Example 12 | Example 13 | Example 14 |
| Dynamic hardness DHs | 0.25 | 0.22 | 0.15 | 0.32 | 0.16 | 0.18 | 0.20 |
| Maximum value DHm of dynamic hardness within range of from 20 μm to 100 μm from edge | 0.36 | 0.40 | 0.20 | 0.45 | 1.62 | 1.89 | 0.35 |
| DHm/DHs | 1.4 | 1.8 | 1.3 | 1.4 | 10.1 | 10.5 | 1.8 |
| Pmax (μm) | 40 | 60 | 100 | 20 | 20 | 20 | 40 |
| Maximum value of dynamic hardness in hardened region | 0.36 | 0.40 | 0.25 | 0.48 | 1.80 | 2.00 | 0.35 |
| Distance from edge to a position in which dynamic hardness is maximum in hardened region | 40 | 60 | 150 | 10 | 10 | 10 | 40 |
| Treatment surfaces in image forming area | 2 surfaces | 3 surfaces | 3 surfaces | 3 surfaces | 3 surfaces | 1 surface Lower surface | 1 surface Vertical surface |
| End surface treatment (outside of image forming area) | Yes | No | Yes | Yes | Yes | No | No |
| Presence or absence of gradual increase from edge to position of Pmax | Present | Present | Present | Absent | Absent | Absent | Present |
| Amount of remaining isocyanate of elastic member | 0.8 | 0.8 | 0.8 | 0.8 | 0.8 | 0.8 | 0.8 |
| Surface hardness of lower surface (first surface) | 0.25 | 0.22 | 0.15 | 0.31 | 0.16 | 0.18 | 0.13 |
| Surface hardness of vertical surface (second surface) | 0.24 | 0.22 | 0.15 | 0.32 | 0.15 | 0.10 | 0.20 |
| Internal dynamic hardness at position 10 μm from edge | 0.26 | 0.23 | 0.16 | 0.48 | 0.80 | 1.11 | 0.21 |
| Internal dynamic hardness at position 20 μm from edge | 0.27 | 0.26 | 0.17 | 0.45 | 1.62 | 1.89 | 0.25 |
| Internal dynamic hardness at position 40 μm from edge | 0.32 | 0.37 | 0.18 | 0.40 | 1.24 | 1.31 | 0.35 |
| Internal dynamic hardness at position 60 μm from edge | 0.36 | 0.40 | 0.19 | 0.36 | 0.86 | 0.79 | 0.30 |
| Internal dynamic hardness at position 80 μm from edge | 0.34 | 0.33 | 0.20 | 0.33 | 0.51 | 0.48 | 0.17 |
| Internal dynamic hardness at position 100 μm from edge | 0.28 | 0.23 | 0.20 | 0.30 | 0.25 | 0.25 | 0.14 |
| Internal dynamic hardness at position 150 μm from edge | 0.18 | 0.15 | 0.25 | 0.22 | 0.12 | 0.13 | 0.10 |

TABLE 4-continued

| | | | | | | | | |
|---|---|---|---|---|---|---|---|---|
| | Internal dynamic hardness at position 200 μm from edge | 0.10 | 0.09 | 0.19 | 0.18 | 0.09 | 0.08 | 0.07 |
| | Internal dynamic hardness at position 300 μm from edge | 0.09 | 0.07 | 0.09 | 0.08 | 0.07 | 0.07 | 0.08 |
| | Internal dynamic hardness at position 500 μm from edge | 0.07 | 0.08 | 0.07 | 0.07 | 0.08 | 0.08 | 0.07 |
| Evaluation (LBP endurance) | Cleaning performance | A | A | C | B | C | D | B |
| | Presence or absence of edge chipping | A | A | A | C | C | C | A |
| | Comprehensive evaluation | A | A | B | B | C | D | B |
| Evaluation for reference (idling) | Turn-up evaluation | A | B | A | A | A | B | B |

| | Example | | | | | |
|---|---|---|---|---|---|---|
| | Example 15 | Example 16 | Comparative Example 1 | Comparative Example 2 | Comparative Example 3 | Comparative Example 4 |
| Dynamic hardness DHs | 0.12 | 0.35 | 0.07 | 0.60 | 0.09 | 0.20 |
| Maximum value DHm of dynamic hardness within range of from 20 μm to 100 μm from edge | 0.96 | 0.42 | 0.09 | 1.00 | 0.12 | 0.18 |
| DHm/DHs | 8.0 | 1.2 | 1.3 | 1.7 | 1.3 | 0.9 |
| Pmax (μm) | 80 | 20 | 40 | 40 | 40 | 20 |
| Maximum value of dynamic hardness in hardened region | 0.96 | 0.42 | 0.08 | 1.00 | 0.12 | 0.20 |
| Distance from edge to a position in which dynamic hardness is maximum in hardened region | 80 | 20 | 40 | 40 | 40 | 0 |
| Treatment surfaces in image forming area | 3 surfaces | 3 surfaces | — | 3 surfaces | 3 surfaces | 3 surfaces |
| End surface treatment (outside of image forming area) | Yes | Yes | — | Yes | Yes | Yes |
| Presence or absence of gradual increase from edge to position of Pmax | Present | Present | — | Present | Present | Absent |
| Amount of remaining isocyanate of elastic member | 0.8 | 0.2 | — | 0.8 | 0.2 | 0 |
| Surface hardness of lower surface (first surface) | 0.12 | 0.35 | 0.07 | 0.60 | 0.09 | 0.20 |
| Surface hardness of vertical surface (second surface) | 0.12 | 0.36 | 0.07 | 0.59 | 0.09 | 0.20 |
| Internal dynamic hardness at position 10 μm from edge | 0.15 | 0.39 | 0.07 | 0.65 | 0.10 | 0.19 |
| Internal dynamic hardness at position 20 μm from edge | 0.18 | 0.42 | 0.08 | 0.88 | 0.11 | 0.18 |

TABLE 4-continued

| | | | | | | | |
|---|---|---|---|---|---|---|---|
| | Internal dynamic hardness at position 40 μm from edge | 0.35 | 0.36 | 0.09 | 1.00 | 0.12 | 0.16 |
| | Internal dynamic hardness at position 60 μm from edge | 0.63 | 0.32 | 0.08 | 0.68 | 0.10 | 0.15 |
| | Internal dynamic hardness at position 80 μm from edge | 0.96 | 0.28 | 0.08 | 0.43 | 0.09 | 0.12 |
| | Internal dynamic hardness at position 100 μm from edge | 0.70 | 0.15 | 0.07 | 0.22 | 0.09 | 0.10 |
| | Internal dynamic hardness at position 150 μm from edge | 0.30 | 0.10 | 0.07 | 0.15 | 0.08 | 0.08 |
| | Internal dynamic hardness at position 200 μm from edge | 0.26 | 0.08 | 0.07 | 0.07 | 0.07 | 0.07 |
| | Internal dynamic hardness at position 300 μm from edge | 0.15 | 0.07 | 0.07 | 0.08 | 0.08 | 0.07 |
| | Internal dynamic hardness at position 500 μm from edge | 0.08 | 0.07 | 0.07 | 0.07 | 0.08 | 0.07 |
| Evaluation (LBP endurance) | Cleaning performance | A | A | E | E | E | E |
| | Presence or absence of edge chipping | A | A | A | D | C | C |
| | Comprehensive evaluation | A | A | E | E | E | E |
| Evaluation for reference (idling) | Turn-up evaluation | A | A | C | A | B | A |

In any of Examples 1 to 14, the dynamic hardness DHs of the surface of the hardened region satisfied the condition of Expression (1), and the maximum value DHm of the dynamic hardness in the inner portion of the free end satisfied the condition of Expression (2). Therefore, satisfactory results were obtained, in which an abutment pressure required for cleaning the surface of the member to be cleaned was ensured to maintain cleaning performance, and edge chipping of the tip end portion of the cleaning blade was reduced even after long-term use. In particular, Examples 1, 8, 15, and 16 were more satisfactory.

In Examples 1 to 12, the hardened region was formed on both the first surface and the second surface forming the edge of the elastic member to be brought into abutment against the member to be cleaned. Therefore, the behavior of the tip end portion during cleaning was stabilized, and the cleaning performance was more satisfactory.

In Example 1 to 11, DHm was set to 10 times or less of DHs, and hence the hardness of the hardened region in the abutment surface was not excessively large. As a result, the rubber elasticity of the tip end portion of the elastic member was not liable to be impaired, and the followability with respect to the member to be cleaned was improved. Therefore, the cleaning performance was more satisfactory.

In Examples 1 to 10, the dynamic hardness gradually increased from the edge to the position of DHm. Therefore, an extremely high hardness region was not present between the edge and the position of DHm, and edge chipping was not liable to occur even after more long-term use.

In Examples 1 to 8 and 10 to 12, both end surfaces in the longitudinal direction had a hardened surface. Therefore, the rigidity of both end surfaces was able to be enhanced, and turn-up of the cleaning blade was even more reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-010734, filed Jan. 22, 2016, and Japanese Patent Application No. 2016-206768, Oct. 21, 2016, which are hereby incorporated by reference herein in their entirety.

What is claimed is:

1. A cleaning blade, comprising:

an elastic member; and a supporting member supporting the elastic member, the elastic member comprising:

a free end portion, the free end portion having a hardened region including an edge that is brought into abutment against a member to be cleaned, and a ridge portion formed by an intersection of a first surface and a second surface of the elastic member, wherein at least one of the first surface and the second surface in the hardened region has a hardened surface that is brought into abutment against the member to be cleaned, and wherein relationships represented by expressions (1) and (2) are satisfied:

$$0.1 \leq DHs \leq 0.4; \text{ and} \quad (1)$$

$$DHs < DHm, \quad (2),$$

where DHs (mN/μm2) represents a maximum value of a dynamic hardness of the hardened surface, and DHm (mN/μm2) represents a maximum value of the dynamic hardness obtained in a positional range in which a distance L from the edge on a straight line that bisects an angle of the edge in a cross-section of the elastic member orthogonal to a longitudinal direction of the elastic member satisfies 0 μm<L≤100 μm.

2. The cleaning blade according to claim 1, wherein a position on the straight line, which represents the maximum value of the dynamic hardness obtained on the straight line, is present at a distance of 20 μm to 100 μm from the edge.

3. The cleaning blade according to claim 1, wherein the dynamic hardness on the straight line gradually increases from the edge to a position representing the DHm.

4. The cleaning blade according to claim 1, wherein the DHm is 1.1 times or more of the DHs.

5. The cleaning blade according to claim 1, wherein DHs<DHm≤10×DHs.

6. The cleaning blade according to claim 1, wherein each end surface of the elastic member in the longitudinal direction of the elastic member has the hardened surface.

7. The cleaning blade according to claim 1, wherein the hardened surface is formed on both the first surface and the second surface.

8. The cleaning blade according to claim 1, wherein the elastic member comprises a polyurethane elastomer.

9. The cleaning blade according to claim 8, wherein the hardened region is formed by impregnation of an isocyanate compound from a surface of the elastic member.

10. A process cartridge, comprising a cleaning blade, the cleaning blade comprising:

an elastic member; and a supporting member supporting the elastic member, the elastic member comprising:

a free end portion, the free end portion having a hardened region including an edge that is brought into abutment against a member to be cleaned, and a ridge portion formed by an intersection of a first surface and a second surface of the elastic member, wherein at least one of the first surface and the second surface in the hardened region has a hardened surface that is brought into abutment against the member to be cleaned, and wherein relationships represented by expressions (1) and (2) are satisfied:

$$0.1 \leq DHs \leq 0.4; \text{ and} \quad (1)$$

$$DHs < DHm, \quad (2),$$

where DHs (mN/μm2) represents a maximum value of a dynamic hardness of the hardened surface, and DHm (mN/μm2) represents a maximum value of the dynamic hardness obtained in a positional range in which a distance L from the edge on a straight line that bisects an angle of the edge in a cross-section of the elastic member orthogonal to a longitudinal direction of the elastic member satisfies 0 μm<L≤100 μm.

11. An electrophotographic image forming apparatus, comprising a cleaning blade, the cleaning blade comprising:

an elastic member; and a supporting member supporting the elastic member, the elastic member comprising:

a free end portion, the free end portion having a hardened region including an edge that is brought into abutment against a member to be cleaned, and a ridge portion formed by an intersection of a first surface and a second surface of the elastic member, wherein at least one of the first surface and the second surface in the hardened region has a hardened surface that is brought into abutment against the member to be cleaned, and wherein relationships represented by expressions (1) and (2) are satisfied:

$$0.1 \leq DHs \leq 0.4; \text{ and} \quad (1)$$

$$DHs < DHm, \quad (2),$$

where DHs (mN/μm2) represents a maximum value of a dynamic hardness of the hardened surface, and DHm (mN/μm2) represents a maximum value of the dynamic hardness obtained in a positional range in which a distance L from the edge on a straight line that bisects an angle of the edge in a cross-section of the elastic member orthogonal to a longitudinal direction of the elastic member satisfies 0 μm<L≤100 μm.

* * * * *